United States Patent [19]

Kimberley

[11] 4,181,494

[45] Jan. 1, 1980

[54] PROCESS FOR TREATING DRILLING CUTTINGS AND MUD

[75] Inventor: Ivan E. Kimberley, Stockport, England

[73] Assignee: West's Pyro Limited, Stockport, England

[21] Appl. No.: 824,141

[22] Filed: Aug. 12, 1977

[30] Foreign Application Priority Data

Aug. 12, 1976 [GB] United Kingdom ..... 33538/76

[51] Int. Cl.[2] ..... F27B 15/00

[52] U.S. Cl. ..... 432/2; 432/14; 432/58

[58] Field of Search ..... 432/2, 14, 15, 58

[56] References Cited

U.S. PATENT DOCUMENTS

| | | | |
|---|---|---|---|
| 2,650,084 | 8/1953 | White | 432/15 |
| 2,774,661 | 12/1956 | White | 432/14 |
| 4,047,883 | 9/1977 | Waters | 432/14 |

*Primary Examiner*—John J. Camby

*Attorney, Agent, or Firm*—Sughrue, Rothwell, Mion, Zinn and Macpeak

[57] ABSTRACT

A process for de-contaminating drilling cuttings and/or drilling mud, contaminated with a hydrocarbon oil, comprising the step of heating the cuttings and/or mud so as to burn off the contaminant whereby the cuttings may be disposed of without environmental spoilage and the mud recycled.

4 Claims, 1 Drawing Figure

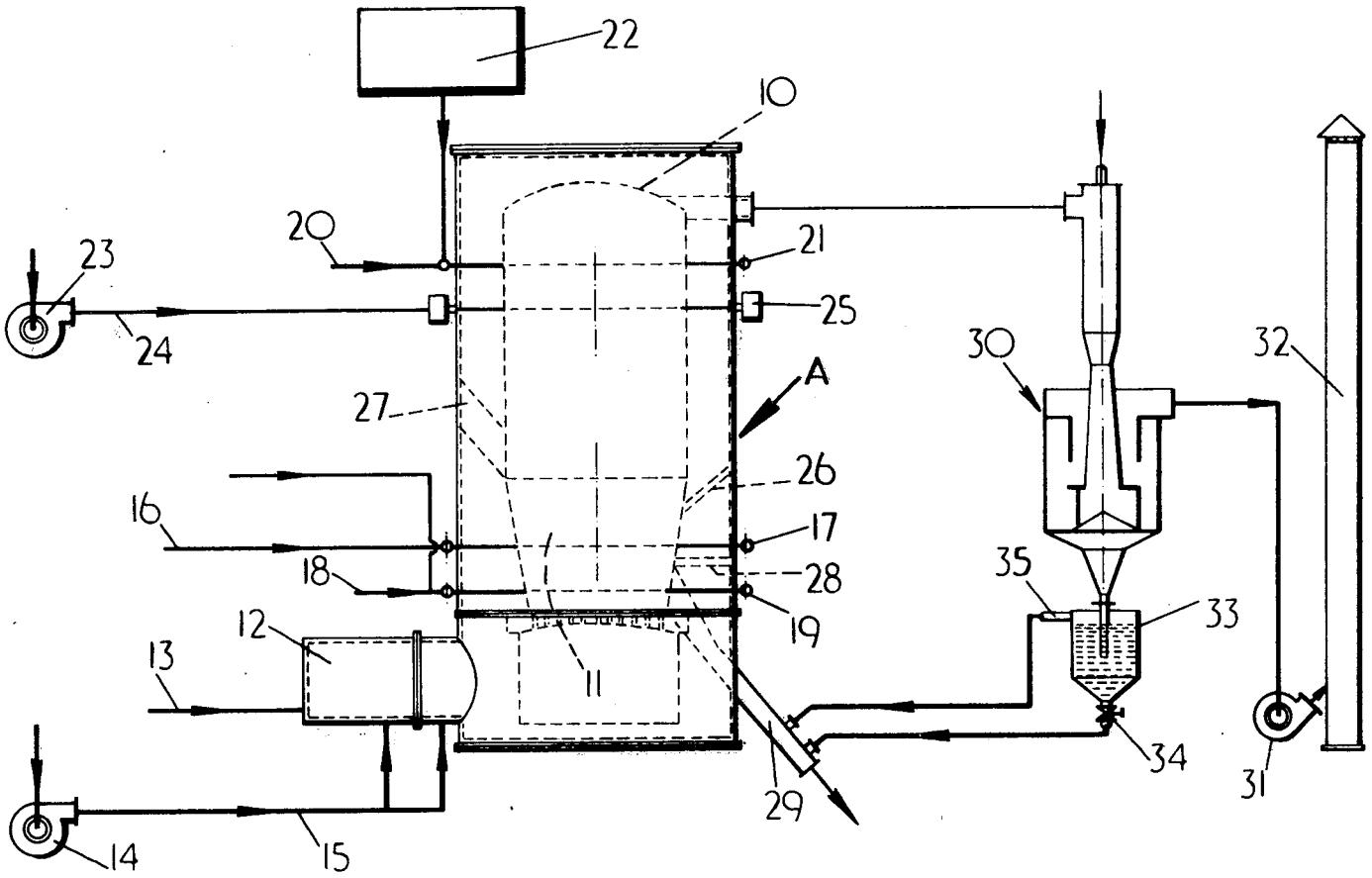
10
11
12
13
14
15
16
17
18
19
20
21
22
23
24
25
26
27
28
29
30
31
32
33
34
35
A

PROCESS FOR TREATING DRILLING CUTTINGS AND MUD

BACKGROUND OF THE INVENTION

The present invention relates to a process for treating both drilling cuttings and waste mud products from oil based mud drilling operations and allows for the disposal of solids which are pollution free.

In drilling operations, e.g. for gas or oil, it is conventional practice to supply the drill bit with a mud lubricant which both cools and lubricates the bit and carries to the surface the drilling cuttings. The mud is separated from the cuttings and the mud is recycled. The cuttings are disposed to waste.

The present invention, however, is particularly concerned with the situation where the lubricating properties of the mud are improved by adding hydrocarbon oil, normally diesel, and in such cases it is found necessary to treat the cuttings to remove the hydrocarbon contamination and also to dispose of spent oil based mud.

Treatment processes available to remove oil from cuttings are solvent washing and distillation. The equipment required for the distillation process is heavy and bulky and is consequently particularly disadvantageous on off-shore drilling rigs.

Solvent extraction requires large quantities of solvents and again the supply and disposal of the solvents is disadvantageous in an off-shore situation. Both processes have the disadvantage that they do not completely remove porosity contamination.

It is therefore the object of the present invention to obviate or mitigate the above mentioned drawbacks.

SUMMARY OF THE INVENTION

According to the present invention, there is provided a process for de-contaminating drilling cuttings and disposing of spent oil based mud. The process for decontaminating drilling cuttings comprises the step of heating the cuttings so as to burn off the hydrocarbon oil contaminant whereby the cuttings may be disposed of without environmental spoilage. Disposal of oil based mud is carried out by burning off the hydrocarbon fraction and recovering mud solid fines for pollution free disposal. The invention may be applied to all drilling operations where mud based lubricants are used whether land-based or off-shore.

BRIEF DESCRIPTION OF THE DRAWINGS

An example of apparatus suitable for carrying out the process of the present invention is illustrated diagrammatically in the accompanying drawing, which shows a simplified partially schematic elevation of an apparatus according to the invention, partly in section.

DETAILED DESCRIPTION OF THE PREFERRED EMBODIMENT

The apparatus for carrying out the process of the present invention comprises a fluidised bed combustor 10 whereof the fluidised bed is indicated at 11. The combustor 10 is substantially conventional in construction and has the usual start-up burner 12 to which is connected by a feed line 13 a fuel supply (not shown). A main air supply fan 14 is connected to burner 12 by a supply line 15 and provides air for combustion at start-up.

This fan 15 also provides fluidising air to the bed 11 and primary air for combustion of the hydrocarbon in the drilling cuttings or oil based mud.

An alternative start-up burner position is indicated at A. This burner would be a single burner and would fire down onto the bed at an angle of 45°.

If the hydrocarbon content in the drilling cuttings increases, secondary air, provided by a fan 23, is introduced into the combustor to provide the additional air necessary for complete combustion. The secondary fan 23 also provides the additional air required for burning the oil based mud.

If the temperature in the combustor rises above normal operating temperature, the excess heat is dissipated by injecting water directly into the bed and into the combustion space above the bed. The water injection system comprises feed lines 18 and 20 connected between a water supply (not shown) and ringmains 19 and 21 from which extend injectors (not shown) directed towards the bed 11 and into the upper portion of the combustor 10. An emergency water head tank 22 is provided in case of failure of the water supply.

If the temperature in the combustor falls below normal operating temperature, additional fuel is supplied by an auxiliary fuel injection system. The auxiliary fuel injection line for the combustor 10 is indicated at 16 for feeding fuel into the latter via a ringmain 17 and injectors (not shown).

An inlet 26 is provided for introduction of the inert particles which make-up the bed 11. Once the bed 11 has been made up this inlet 26 is closed until further making-up is necessary.

A downwardly-inclined feed inlet for contaminated drilling cuttings is indicated at 27, the drilling cuttings being delivered thereto from an open-bottomed hopper by multiple screws and a final single water-cooled screw.

A further feed inlet 28 is provided and through which the oil based mud can be pumped into the combustor.

The discharge from the combustor 10 is indicated at 29 and through this is discharged decontaminated drilling cuttings or solids from the oil based mud, i.e. both free of hydrocarbon contamination.

The exhaust products of the combustor 10 which include fine materials and mud solids fines are delivered to a Venturi Scrubber 30 into the top of which is fed cooling water. Separation and cooling occurs in the Venturi Scrubber 30, and the exhaust gases are discharged by exhaust fan 31 via an exhaust stack 32 to atmosphere. The solids pass into a seal pot 33 which has a drain valve 34 and overflow 35 both of which are connected to the combustor discharge 29.

The combustor 10 is usually fed with only contaminated drilling cuttings or spent oil based mud at any one instance although it is envisaged that both could be supplied at the same time.

A high pressure air line 36 is connected to water injection systems 18, 19 and services to purge the ringmain 19 and keep same clean. Similar provision is made for the auxiliary fuel supply system 16, 17 and the oil based mud inlet 28 and feed line.

In use, the contaminated drilling cuttings are, or the oil based mud is, heated in the fluidised bed 11 of the combustor 10 to burn off the diesel oil, the heated bed being composed, as aforesaid, of inert particles which are stable at the operating temperature.

To start the process of the invention the fluidised bed is heated to a suitable temperature, usually between 700° and 1000° C. and the contaminated drilling cuttings or oil based mud then supplied into the bed.

The hydrocarbon content of the cuttings or mud contributes to the heat requirements of the process. The process will be either endothermic or exothermic depending on the hydrocarbon content of the feed. When the hydrocarbon content falls below the level required to maintain the operating temperature in the bed provision is made, as aforesaid, to supply additional heat, if necessary, via 16 and 17. Where the heat content of the hydrocarbon contaminant is in excess of process requirement combustor temperature is controlled as aforesaid, by water injection into the combustor.

The treated drilling cuttings or oil based mud, both freed from contaminant are discharged via 29, either directly or where carried by the exhaust gases after passage through the wet scrubber 30 or alternatively a dry cyclone.

If required, heat may be recovered from the exhaust gases by conventional means.

Where the treated cuttings discharge via the fluidised bed overflow they will carry with them inert material forming the original bed. Provision is made for adding fresh material but in general the treated cuttings are suitable as inert bed material and the bed is normally self sustanining.

The invention has the advantages that porosity contamination of the drilling cuttings is removed, allowing subsequent pollution free disposal and the heating value of the hydrocarbon contaminant is utilised to obtain optimum process thermal efficiency.

What is claimed is:

1. A process for de-contaminating drilling cuttings contaminated with hydrocarbon oil or oil-based liquid mud employed in drilling operations and contaminated with hydrocarbon oil, comprising the steps of:

(a) providing a fluidised bed of inert particles, (b) heating the fluidised bed to a predetermined operational temperature to start up the process (c) delivering hydrocarbon oil-contaminated drilling cuttings down onto the surface of the heated fluidised bed or liquid mud into the heated fluidised bed whereby the hydrocarbon oil burns and contributes to the heat requirements of the process, (d) controlling the operational temperature of the process by the addition of fuel to the fluidised bed and a temperature dissipant to both the interior and upper surface of the fluidised bed, and (e) discharging hydrocarbon-free drilling cuttings or mud solids from the bottom of the fluidised bed.

2. A process according to claim 1, further comprising the step of recovering cutting fines or oil based mud solids fines from exhaust gases of the combustor before they egress to atmosphere.

3. Apparatus for de-contaminating drilling cuttings contaminated with hydrocarbon oil or oil-based liquid mud employed in drilling operations and contaminated with hydrocarbon oil, comprising:

(a) fluidised bed combustor, (b) a fluidised bed of inert particles arranged within said combustor, (c) a start-up burner for heating the fluidised bed to a predetermined operational temperature, (d) a first feed inlet through which contaminated drilling cuttings can be delivered down onto the surface of the fluidised bed, (e) a second feed inlet through which contaminated mud can be pumped into the bed, (f) a temperature dissipating injection system including separate means for supplying water or the like to both the interior and upper surface of the fluidised bed for lowering the operational temperature, (g) an auxiliary fuel injection system for supplying additional fuel to raise the operational temperature, and (h) a common bottom discharge for hydrocarbon-free drilling cuttings and mud solids.

4. Apparatus according to claim 3, in which the combustor exhaust is connected to a venturi scrubber wherein fine solid materials are extracted from the exhaust products of the combustor.

* * * * *